United States Patent [19]

Kirkpatrick

[11] Patent Number: 4,791,846

[45] Date of Patent: Dec. 20, 1988

[54] OSCILLATING FREE WHEELING RESILIENT COVER FOR ROTARY DIE-CUTTING ANVIL

[75] Inventor: Alan D. Kirkpatrick, Martinsville, N.J.

[73] Assignee: Robud Company, Pine Brook, N.J.

[21] Appl. No.: 112,816

[22] Filed: Oct. 23, 1987

[51] Int. Cl.[4] ..... B26D 7/20

[52] U.S. Cl. ..... 83/659; 83/347; 83/348

[58] Field of Search ..... 83/346, 347, 348, 659, 83/698, 510, 511; 493/354, 365, 371, 403; 74/57

[56] References Cited

U.S. PATENT DOCUMENTS

| | | | |
|---|---|---|---|
| 582,244 | 5/1897 | Tuckfield | 74/57 |
| 2,400,527 | 5/1946 | Aycock | 83/659 |
| 3,274,873 | 9/1966 | Sauer | 83/659 |
| 3,792,616 | 2/1974 | Wentzel | 74/57 |
| 4,063,493 | 12/1977 | McEvers et al. | 83/347 |
| 4,073,208 | 2/1978 | Kirkpatrick | 83/659 |
| 4,295,843 | 10/1981 | Otomaru | 493/354 |

*Primary Examiner*—Paul A. Bell
*Assistant Examiner*—Scott A. Smith
*Attorney, Agent, or Firm*—John G. Gilfillan, III

[57] ABSTRACT

Rotary die cutting apparatus wherein the die blanket is mounted with respect to the anvil head such that both longitudinal and transverse relative movement is permitted between the die blanket and the anvil head during operation of the apparatus.

12 Claims, 3 Drawing Sheets

OSCILLATING FREE WHEELING RESILIENT COVER FOR ROTARY DIE-CUTTING ANVIL

BACKGROUND OF THE INVENTION

This invention pertains generally to die cutting. More specifically this invention relates to anvil structure for use in conjunction with die cutting apparatus, the anvil structure defining a reaction surface for the cutting rules of die cutting structure.

Rotary die cutting pertains to the art of cutting a moving workpiece, e.g. a continuously moving web or a sheet of material, without interrupting the movements of the workpiece. In typical applications, moving webs or sheets of material such as cardboard and corrugated paperboard, are passed between a cutting roller and an anvil roller. Cutting elements known as cutting rules are mounted on the cutting roller for rotation therewith. The anvil roller is provided with a cylindrical cover known as a cutting die blanket which fits around the surface of the anvil roller and effectively increases its diameter by twice the blanket thickness. The axes of rotation of the cutting roller and the anvil roller are parallel and displaced by an amount such that at their points of closest proximity the cutting rules penetrate the surface of the die blanket.

As the cutting rules penetrate the surface of the die blanket, a resistance to the penetration is developed which, for purposes of this application, is called a reaction force. Adjustment of the relative positions of the axes of rotation of the cutting die roller and the anvil roller is made to provide a degree of penetration and therewith a degree of reaction force sufficient to insure complete cutting of the moving web or sheet of material.

Over the years those concerned with the design, construction and operation of rotary die cutting apparatus have devised varied approaches to avoid having the cutting rules strike the die blanket repetitively at the same location. Such repetitive striking causes excessive blanket wear at the location of the strike with virtually no wear at other locations on the blanket surface.

In some conventional die cutting apparatus the shafts of the cutting roller and the anvil roller are mechanically inter-engaged through a gearing pair. The gear of the anvil roller shaft may have one less tooth than the gear of the cutting roller shaft or, for the same purpose as is discussed below, the diameters of the rollers may be slightly different. The purpose of such structure is to create a difference in the circumferential velocity of rotation of the cutting and anvil rollers so that the cutting rules do not strike repetitively the same locations on the die blanket surface. Rather, the disparity in rotation permits the cutting rules to strike a different location on the surface of the blanket at each successive rotation thus prolonging the life of the cutting blanket.

In those die cutting apparatus wherein different degrees of circumferential velocity between the anvil roller and the cutting roller are not permissible, e.g. adaptation of printer-slotter apparatus to perform a die cutting function, various approachs have been taken to preclude repetitive striking of the die blanket by the cutter rule. One of these has been to provide sliding anvil blankets. Such an approach is disclosed in U.S. Pat. No. 3,282,142 issued for an ANVIL FOR ROTARY DIE CUTTING, U.S. Pat. No. 3,522,754 issued for a REINFORCED FREE WHEELING RESILIENT COVER FOR ROTARY DIE CUTTING ANVIL, and in U.S. Pat. No. 3,274,873 issued for a ROTARY ANVIL CONSTRUCTION.

Another approach to solving the problem of repetitive striking of the die blanket at the same location is found in my U.S. Pat. No. 4,073,208 for an ANVIL STRUCTURE FOR ROTARY DIE CUTTING APPARATUS. The structure disclosed in this patent embodies a die blanket rigidly mounted on a slip bearing which is mounted on the anvil head.

Although my pateneted anvil structure solved many of the problems presented by prior approaches, the relative displacement it provided was in a single direction, i.e. linearly around the surface of the anvil head. Thus, in applications where the cuts are relatively long and linearly oriented in the direction of passage of the workpiece between the cutting roller and the anvil roller, prior art structures may reduce repetitive striking at the same location on the die blanket, but large areas of the die blanket surface remain untouched by the time the anvil structure must be reconstructed by replacement of the blanket.

Needless to say, the failure to utilize larger areas of the die blanket surface results in more frequent reconstruction of the anvil structure by replacement of the blanket with attendant machine down time. Thus, any structure which increases use of die blanket surface while minimizing repetitive striking of the blanket surface at the same location is highly desirable.

SUMMARY OF THE INVENTION

It is an object of the present invention, therefore to provide a free wheeling resilient cover or die blanket for a rotary die-cutting anvil which improves utilization of the surface of the cover or blanket.

A further object of the present invention is to provide a free wheeling resilient cover or die blanket for a rotary die-cutting anvil which is capable of manufacture for reasonable costs using known manufacturing techniques.

Yet an additional object of the present invention is to provide a free wheeling resilient cover or die blanket for a rotary die-cutting anvil which requires less frequent replacement.

These objects and others not enumerated are achieved by the structure of the present invention. One embodiment of which may include an anvil head for mounting on a rotatable shaft, a die blanket means mounted with respect to the anvil head such as to permit both longitudinal and transverse relative motion therebetween and means for limiting the transverse relative motion between the die blanket and the anvil head.

BRIEF DESCRIPTION OF THE DRAWINGS

A more complete understanding of the present invention may be had from the following detailed description thereof, particularly when read in the light of the accompanying drawings, wherein.

DETAILED DESCRIPTION

As noted above, the present invention relates to anvil structure for use in conjunction with die cutting apparatus, the anvil structure defining a reaction surface for the cutting rules of die cutting structure.

Figure 1:
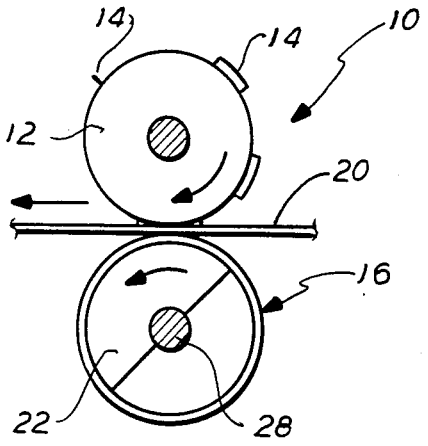
FIG. 1 is a schematic elevational view of a first embodiment of die cutting apparatus incorporating an anvil structure according to the present invention.

Referring therefore to FIG. 1, there is shown schematically a rotary die cutting structure designated generally by the reference numeral 10. Die cutting structure 10 is of the type which may be utilized to adapt apparatus such as a printer-slotter for accomplishing rotary die cutting.

Die cutting apparatus 10 includes a cutting roller 12 having a plurality of cutting knives or rules 14 mounted thereon and an anvil roller designated generally by the reference numeral 16, which anvil roller is structured in accordance with the teaching of the present invention.

Die cutting apparatus 10 is shown in FIG. 1 to be cutting a web of material 20, e.g. cardboard or corrugated board as it passes between rollers 12 and 16 from right to left as shown. As noted above, it may well be that cutting is occurring substantially simultaneously with a printing and slotting operation. Cutting roller 12 and anvil roller 16 rotate in the clockwise and counterclockwise directions, respectively, at an angular rate which is such as to cause their surface velocities to be identical at their common line of tangency to the speed of advance of web 20. This relationship permits cutting of the web material in what is substantially a radially directed in and out motion. As is discussed below in detail, however, the anvil roller 16 is provided with a blanket structure which is slidable around the periphery of the anvil head, both in the longitudinal and transverse directions, in response to the action of the cutting rules. This, of course, precludes the continuous subjection of individual localized areas of the blanket to wear. Rather, the blanket wear is evenly distributed over its surface.

Disclosed hereinafter are three embodiments of anvil rollers which embody the present invention. As the first embodiment, with particular reference to FIGS. 2–4, there are shown a detailed elevational view and a side view of anvil roller 16, respectively, and an elevational view of anvil head 22 (FIG. 4).

Anvil head 22 comprises a pair of half-head sections 30, 31 which are rigidly secured to shaft 28 by bolts 33 mounted in stepped bores 34 in the well known manner. Shaft 28 is received through a bore 29 formed in anvil head 22 by the cooperation of aligned semi-circular bores formed in half head sections 30, 31.

Formed in the circumferential surface 36 of anvil head 22 is an annular channel 37. The plane defined by the channel 37 is oriented at an angle to the centerline of bore 29 such that the centerline of channel 37 is disposed between a first position A proximate the first radial surface 38 of head 22 and a second position B proximate the second radial surface 39 of head 22; any particular position of the centerline of channel 37 between positions A and B being dependent upon the angular displacement of the particular position from positions A and B. In this regard, the structure of anvil head 22 as shown in FIG. 4 is common to all embodiments of the present invention disclosed in this specification as being preferred embodiments.

Figure 2:
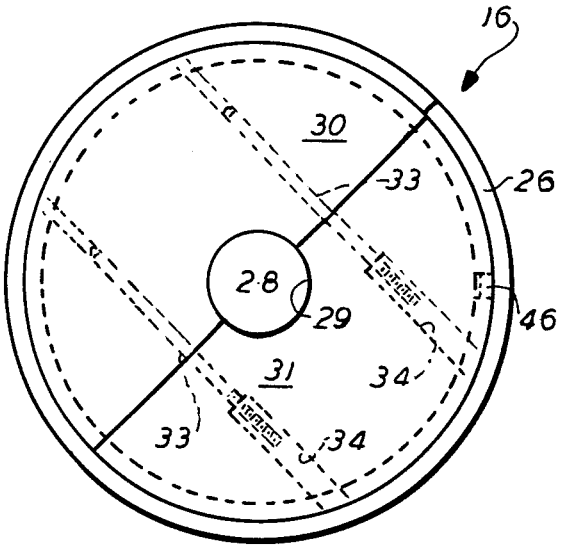
FIG. 2 is a cross-sectional elevational view of anvil structure according to the invention taken generally through the center line plane of the anvil structure of FIG. 1.
Figure 3:
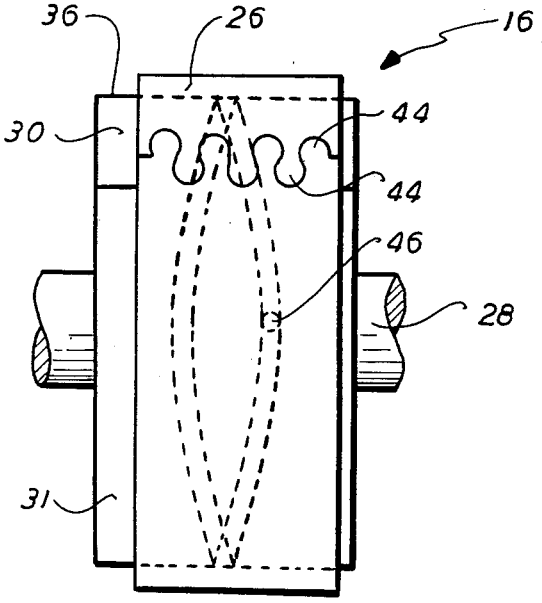
FIG. 3 is a side view of the structure of FIG. 2.
Figure 4:
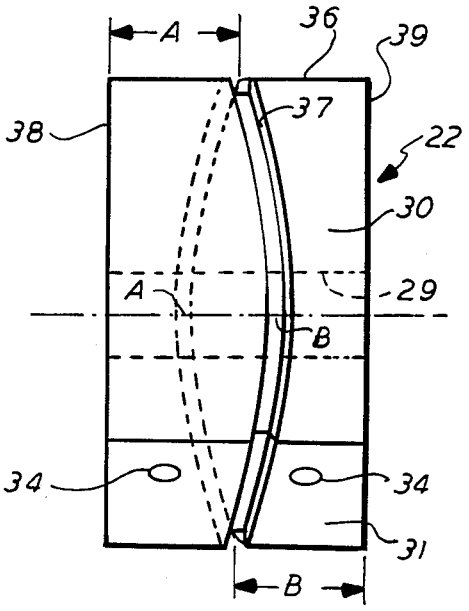
FIG. 4 is an elevational view of an anvil head which may be used with both disclosed embodiments of the present invention.

Referring now to FIGS. 2 and 3, anvil blanket 26 can be seen to be a generally cylindrical structure having inter-engaging locking fingers 44 disposed on each transverse end which, when the blanket 26 is wrapped around anvil head 22, cooperate to lock the blanket onto the surface 36 of head 22 such that it is firmly supported but capable of slippage with respect to the surface of the head. Inter-engaging locking fingers 44 may be generally of the type disclosed in U.S. Pat. No. 3,522,754 (see FIGS. 9 and 10)

Formed on the inner surface of blanket 26 is a projection 46 which extends radially inwardly. Projection 46 is sized to be received loosely slidably within channel 37 of head 22. Projection 46 cooperates with channel 37 to position blanket 26 transversely on the surface 36 of head 22.

Assembly of anvil roller 16 is straight forward. Anvil head sections 31 and 32 are positioned on shaft 28 and rigidly secured thereto by bolts 33 cooperating with stepped bores 34 and suitable nuts or tapped bore sections as may be desired. Blanket 26 is then wrapped around surface 36 of head 22 such that projection 46 is received within channel 37. Thereafter locking fingers 44 are interengaged so as to retain the blanket 26 sungly but slidably in the surface 36 of head 22. The snug but slidable engagement of blanket 26 on head 22 permits both longitudinal (around surface 36) and transverse (across surface 36) movement between the blanket and the head. As is clear from the structural relationships, there is no limit to the degree of longitudinal relative movement between head and cover; however, transverse relative movement is limited by the cooperation of projection 46 and channel 37.

In the operation of die cutting structure 10, web of material 20 is fed between cutting roller 12 and anvil roller 16 in the manner shown in FIG. 1. As previously has been recognized by those skilled in these arts, notwithstanding that rollers 12 and 16 are rotating such that their tangential surface velocities are equal, the action of cutting rules 14 in penetrating the web 20 and the surface of blanket 26 causes a tendency to displace the blanket 26 with respect to head 22. In prior art anvil roller structures such relative displacement has been limited to longitudinal (rotational) relative movement. However, in the present invention, because of the orientation of channel 37 on the anvil head surface, longitudinal displacement of blanket 26 also results in transverse displacement of blanket 26 in head 22. This combined longitudinal and transverse relative displacement further reduces localized wear of the blanket surface thus increasing the useful life of the blanket, reducing blanket replacement costs and equipment downtime for reconstruction of the anvil roller structure by blanket replacement.

Although the embodiment of FIGS. 1 through 3 has been disclosed in the context of a one-piece anvil blanket. those skilled in this art will recognize that the anvil blanket may be any of many designs with the limitation that it be capable of relative movement in the anvil head and that a projection be provided for cooperating with the channel in the anvil head to provide both longitudinal and transverse relative movement.

Figure 5:
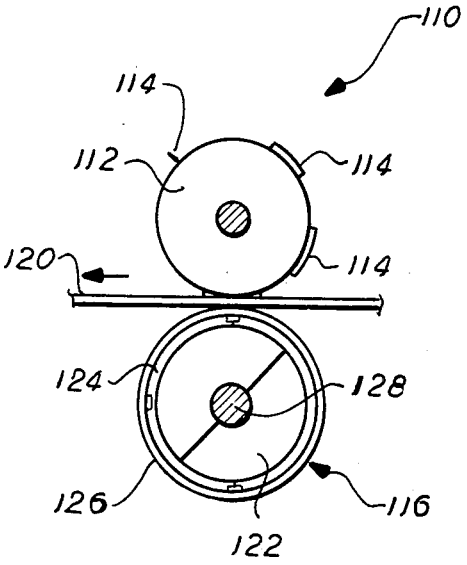
FIGS. 5 and 6 are views corresponding to FIGS. 1 and 2 but of a second embodiment of anvil structure according to the present invention.

Considering now a second embodiment of anvil roller according to the present invention and with particular reference to FIG. 5, there is shown schematically a rotary die cutting structure designated generally by the reference numeral 110. Die cutting apparatus 110 includes a cutting roller 112 having a plurality of cutting knives or rules 114 mounted thereon and an anvil roller designated generally by the reference numeral 116 structured in accordance with the teaching of the present invention.

As is the case with respect to the embodiment of FIG. 1, die cutting apparatus 110 is shown in FIG. 5 to be cutting a web of material 120 as it passes between rollers 112 and 116 from right to left as shown. As noted above with respect to the embodiment of FIG. 1, it may well be that the cutting is occurring substantially simultaneously with a printing and slotting operation. Cutting roller 112 and anvil roller 116 rotate in the clockwise and counter-clockwise directions, respectively, at an angular rate which is such as to cause their surface velocities to be identical at their common line of tangency to the speed of advance of web 120. Once again, however, the anvil blanket is slidable both longitudinally and tangentially with respect to the surface of the anvil head so as to preclude the continuous subjection of individual localized areas of the blanket to wear. Rather, the blanket wear is evenly distributed over its surface.

Figure 6:
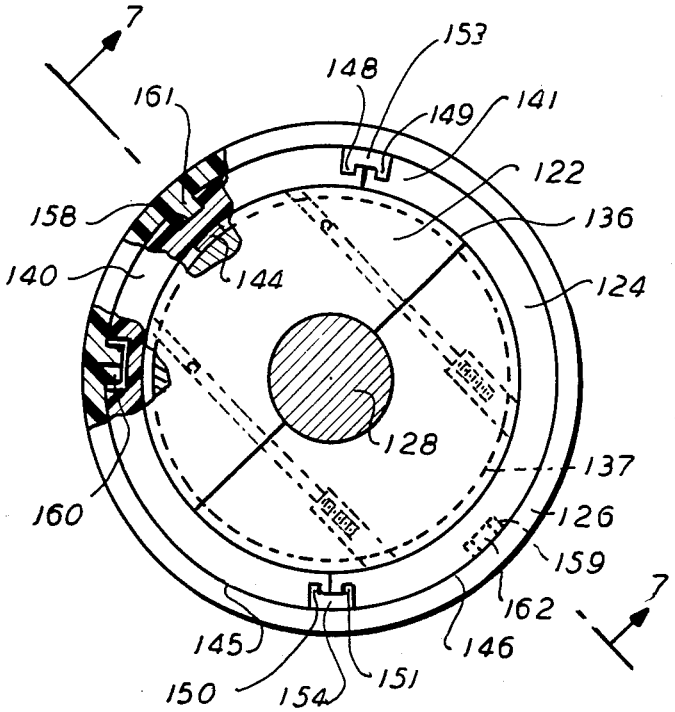
Figure 7:
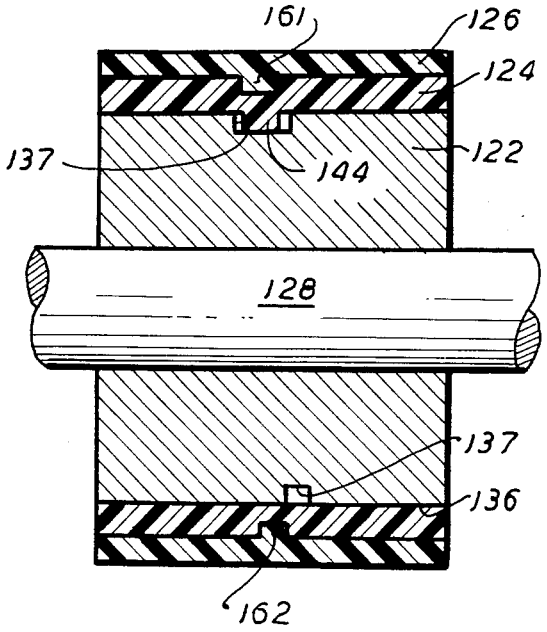
FIG. 7 is a cross-sectional view through the plane 7—7 of FIG. 6.

Considering the novel anvil roller structure of this embodiment, and with particular reference to FIGS. 6 and 7, anvil roller can be seen to comprise an anvil head 122, a slip ring 124 and a die blanket 126, all mounted on shaft 128. In this regard, the structure of anvil head 122 is identical to that described above with respect to FIGS. 2, 3 and 4. Accordingly no detailed description of head 122 will be made, it being understood that reference to head surface 136 and channel 137 relates to structure which is identical to head surface 36 and channel 37 of anvil head 22.

Slip ring 124 comprises a pair of half-ring sections 140, 141, which when assembled define a generally cylindrical member having an inner surface adapted to be in slidable engagement with peripheral surface 136 of anvil head 122. Formed to extend radially inwardly from half-ring section 140 is a projection 144 which is adapted to be slidably received within channel 137 formed in the peripheral surface 136 of head 122. Thus, by reason of the configuration of channel 137, displacement of the slip ring 124 with respect ot the surface of head 122 results in both longitudinal and transverse movement of the blanket in the head.

With the exception of the projection 144 in half-ring section 140, and a channel 160 described in detail below, the structure of each half section 140, 141 of slip ring 124 is identical. The external surfaces 145, 146 of each half section are cylindrical. The transverse edges of peripheral surfaces 145, 146 are each relieved to define U-shaped channels 148, 149, 150 and 151. The U-shaped channels, upon assembly of half-sections 140, 141 cooperate to define a pair of U-shaped channels in which are received a pair of U-shaped locking strips 153, 154. Thus, U-shaped locking strip 153 cooperates with channels 148 and 149 to lock half-sections 140, 141 together along their first common adjacent transverse edges. Similarly, U-shaped locking strip 154 cooperates with channals 150 and 151 to lock half-sections 140, 141 together along their second common adjacent transverse edges. The outer surfaces of locking strips 153, 154 are slightly rounded to cooperate with the outer surfaces 145, 146 of half-sections 140, 141 to define a smooth, consistent cylindrical surface.

In the embodiment shown, the outer surface 145 of half-section 140 is relieved to define a transversely extending channel 160. Channel 160 accommodates the reception therein of the locking elements of die blanket 126. In this regard, it has been found that superior operating results may be achieved through the use of a die cutting blanket having locking structure of the type disclosed in my U.S. Pat. No. 4,073,207 issued Feb. 14, 1978 for LOCK FOR ROTARY DIE CUTTING BLANKET. Thus, channel 160 may be structured to accommodate a blanket lock in accordance with the teaching of that invention. Alternatively, however, die blanket 126 may be secured to slip ring 124 in any other of the more conventional manners as are known to those skilled in these arts.

Also formed in the peripheral surfaces 145, 146 of half-sections 140, 141 are centrally disposed slots 158, 159. Slots 158, 159 extend partially through half-sections 140, 141 and are designed to accommodate therein projections 161, 162 which are formed on the inner surface of blanket 126. Projections 161, 162 are received snugly transversely (FIG. 7) and loosely longitudinally (FIG. 6) within slots 158, 159 respectively in order that they may be easily inserted yet maintain blanket 126 snugly on slip ring 124.

Blanket 126 is a generally cylindrical structure having a locking means formed on each transversely extending edge. As noted above, the locking structure may be of the type disclosed in my above-identified patent or it may be one of the previously known types. The major portion of the inner surface of blanket 126, when assembled, defines a cylindrical surface having a diameter substantially equal to the outside diameter of slip ring 124 such that the two components are in substantially total surface-to-surface engagement. The outside diameter of blanket 126 corresponds to the diameter desired to achieve optimum cutting results through the cooperation of cutting rules 114 and blanket 126.

With respect to both blanket 26 and blanket 126, the projections 46 and 144 are dimensioned to be slightly smaller than the widths of channels 37 and 137 respectively. This disparity in dimension provides a degree of transverse freedom of the projections within the channels. Such freedom may be desirable where the action of the cutting rule, in causing longitudinal displacement of the blanket with respect to the anvil head, is subjected to transverse stresses by reason of the tendency of the blanket to follow the path of the channels. For most applications, the transverse freedom of the projections within the channels is sufficient to preclude generation of such stresses in the rules as would cause them to break. For exceptionally long rules extending longitudinally with respect to the blanket, it may be required to provide specific structure to relieve transverse stresses imposed on the rules during cutting.

Figure 8:
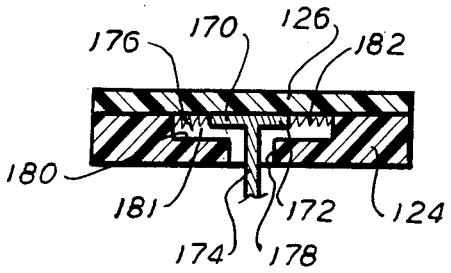
FIG. 8 is a partial transverse cross-sectional view of a modified structure of means for limiting transverse relative movement between a die blanket and anvil head.
Figure 9:
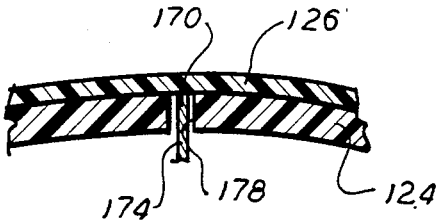
FIG. 9 is a partial longitudinal cross-sectional view of the structure shown in FIG. 8.

Referring therefore to FIGS. 8 and 9, there is shown a modification to the embodiment of FIGS. 5 through 7 which provides for transverse displacement of the projection which connects the blanket assembly with the head independent of the position of the head.

More specifically, FIGS. 8 and 9 show blanket 126 and slip ring 124 in assembled condition as discussed above. Formed in slip ring 124 is a T-shaped slot 180, the head of the slot extending transversely of the slip ring. Thus, the cooperation of the slip ring 124 and blanket 126 cooperate to define a T-shaped cavity in which is received a T-shaped element 170. With particular reference to FIG. 8, it can be seen that T-shaped element 170 has a head section 172 and a stem section 174. Head section 172 is received within the transversely extending cavity 176 of T-shaped slot 180. The stem section 174 is received within the radially extending portion 178 of slot 180. Disposed between the ends of head section 172 and the outer surfaces of cavity 176 are coil springs 181, 182 which, when the structure is assembled, tend to urge the element 170 centrally by equal forces, thereby maintaining element 170 central of transversely extending cavity 176. In this regard, although coil springs are disclosed, the function of this element may be achieved by other resilient means such as leaf springs and the like.

The transverse dimension of the radially extending portion 178 of slot 180 is larger than the transverse dimension of the stem section 174 of T-shaped element 170. Thus, a transversely directed force against stem section 174, while holding blanket 126 in place, may cause transverse displacement of T-shaped element 170 against the action of either spring 181 or 182. If the restraint against blanket 126 is removed, the action of the compressed spring will be such as to displace the T-shaped element 170 to a position central of the slot such as to reestablish equilibrium between the spring forces.

Such a capability is relevant to the present invention. It may be that a particular cutting rule 114 may be sufficiently long as to displace the blanket 126 longitudinally in anvil head 122 by a significant amount. Such a displacement will cause the connecting projection between the blanket assembly and head to be displaced transversely by the geometry of channel 137. In the structure of FIGS. 8 and 9, if such displacement occurs while the cutting rule is embedded in the blanket thus holding the blanket against transverse movement, T-shaped element will be displaced against the force of the springs thus avoiding subjecting the rule to transverse forces which otherwise might result in their being broken. Upon removal of the rule from the blanket, the blanket is free to be displaced with respect to the anvil head which displacement occurs in response to the force of the compressed spring. This feature thus provides for both longitudinal and transverse displacement capability of the blanket, even for applications where relatively long longitudinal cuts must be made by single rules.

Assembly of the structure of FIGS. 8 and 9 is relatively simple. Prior to mounting blanket 126 on slip ring 124, T-shaped element 170 is positioned in slot 180 as shown between springs 181 and 182. With the element so positioned, blanket 126 is mounted on the slip rings and locked in position thereby maintaining the element 170 in operating position within the slot.

It should be recognized that although the use of a biased projection means has been disclosed in the context of element 170 in the embodiment of FIGS. 5–9, similar structure may be provided as part of blanket 26 of the embodiment of FIGS. 1–3 or otherwise in the context of other blanket structures well known to those skilled in the arts.

As to the physical make-up of the structures, the material of the anvil head 22 may be any of the ordinarily accepted materials for such structures as are generally known by those having ordinary skill in these arts. The die blankets 26 and 126 may be of polyurethane, polyvinyl chloride, chlorinated butyl rubber and the like. The slip ring 124 may be manufactured from material identical to that of the die blanket, or more desirably, it may be manufactured from a phenobic, e.g. 70–80 Shore D plastic material. Further, the respective elements may be manufactured, using techniques which are well known to those skilled in the art.

Considering the complete assembly of anvil structure 116, head sections 131 and 132 are positioned on shaft 128 and rigidly secured thereto by bolts 133 cooperating with stepped bores 134 and suitable nuts or tapped bore sections as may be desired. Slip ring half sections 140 and 141 are then positioned around anvil head 122, such that the above-discussed surface-to-surface engagement is achieved and projection 144 is positioned within channel 137 in anvil head 122. With the half sections are positioned, locking elements 153 and 154 are inserted to effect rigid locking of the half sections together. Further, if the structure of FIGS. 8 and 9 is being utilized, the T-shaped element 170 is positioned as discussed above and its stem is positioned within channel 137. At this juncture, the assembly is ready for mounting die blanket 126. Projections 161 and 162 are inserted into slots 158 and 159 respectively. The blanket is smoothed over the surface of slip ring 124, the locking elements are inserted within channel 160 and the blanket locked securely in place. So assembled, the anvil assembly is ready for operation.

It will be recognized by those skilled in these arts that anvil assemblies structured in accordance with the present invention provide a distinct advantage over the prior art. Namely, anvil assemblies according to the present invention provide for both longitudinal and transverse relative movement between the anvil blanket and the anvil head. Such relative movement precludes localized wear of the anvil blanket, thereby extending the life of the blanket and anvil roller structure and reducing the downtime necessary for replacing blankets during reconstruction of the assembly upon reaching the end of the useful life of the blanket. Additionally, a feature of the present invention is the provision for reducing transverse stresses in cutting rules resulting from the projected transverse movement of the blanket on the anvil head. Such provision permits the teaching of the present invention to be followed even in applications requiring lengthy cutting rules disposed in the longitudinal direction.

It will also be recognized by those having skills in these arts that many modifications and variations may be made to the disclosed embodiments without departing from the spirit and scope of the invention.

What is claimed is:

1. Anvil structure for rotary die cutting apparatus comprising:

an anvil head suitable for mounting on a rotatable shaft, said anvil head having a peripheral surface and an axis of rotation which is coaxial with the axis of rotation of said shaft;

die blanket means mounted with respect to said anvil head such as to permit both longitudinal and transverse relative movement between said peripheral surface of said anvil head and said die blanket means; and means cooperating with said anvil head and said die blanket means for effecting said transverse relative movement between said peripheral surface of said anvil head and said die blanket means.

2. Anvil structure according to claim 1 wherein said means cooperating with said anvil head and said die blanket means includes a channel formed in said anvil head.

3. Anvil structure according to claim 2 wherein said means cooperating with said anvil head and said die blanket means includes a projection operatively connected to said die blanket means, said projection being received within said channel formed in said anvil head.

4. Anvil structure according to claim 3 wherein said projection is connected to said die blanket means.

5. Anvil structure according to claim 3 and further including a ring means disposed between said die blanket means and said anvil head, said die blanket means being secured to said ring means, and said projection being disposed on said ring means.

6. Anvil structure according to claim 3 wherein said projection is transversely displaceable with respect to said die blanket means.

7. Anvil structure according to claim 6 including spring means disposed to resist transverse displacement of said die blanket means.

8. Anvil structure according to claim 2 wherein said channel formed in said anvil head is contained within a plane which defines an acute angle with respect to the axis of rotation of said anvil head.

9. Anvil structure according to claim 3 wherein said projection is dimensioned to be loosely received within said channel to permit a degree of transverse movement of said projection within said channel.

10. A rotary die cutting anvil comprising:

a generally cylinderical anvil head having an axis of rotation and a coaxial peripheral, cylinderical surface;

a die blanket frictionally mounted on said peripheral surface for rotation therewith and for permitting slideable displacement of said blanket with respect to said surface in a transverse direction parallel to said axis; and means for moving said die blanket with respect to said anvil head in said transverse direction in response to relative rotational movements of said die blanket with respect to said head.

11. An anvil according to claim 10 wherein said means includes a channel formed in said surface and a projection extending from said blanket into slideable engagement in said channel.

12. An anvil according to claim 11 wherein said projection is resiliently coupled to said die blanket to permit limited resilient movement between said head and said blanket in said transverse direction.

* * * * *